United States Patent [19]

Goetjen

[11] 3,970,200

[45] July 20, 1976

[54] GANTRY

[75] Inventor: Ted G. Goetjen, Silver Spring, Md.

[73] Assignee: George Hyman Construction Co., Bethesda, Md.

[22] Filed: Jan. 16, 1975

[21] Appl. No.: 541,646

[52] U.S. Cl. ..... 214/1 H; 52/749; 61/45 D

[51] Int. Cl.[2] ..... B25J 3/00

[58] Field of Search ..... 214/1 H, 1 S, 1 SW; 61/45 R, 45 D; 52/749, 750

[56] References Cited

UNITED STATES PATENTS

| | | | |
|---|---|---|---|
| 3,298,154 | 1/1967 | Behr | 52/749 |
| 3,409,158 | 11/1968 | Lull | 214/1 H |
| 3,468,510 | 9/1969 | Wehner | 61/45 D |
| 3,552,583 | 1/1971 | Toffolon | 214/1 H |
| 3,679,177 | 7/1972 | Scholz | 214/1 H |
| 3,796,334 | 3/1974 | Torrey | 214/1 H |
| 3,863,420 | 2/1975 | Peiffer | 52/749 |

*Primary Examiner*—M. H. Wood, Jr.
*Assistant Examiner*—John A. Carroll
*Attorney, Agent, or Firm*—Cushman, Darby & Cushman

[57] ABSTRACT

A gantry for use in positioning heavy arcuate ceiling blocks in a tunnel with upstanding legs supporting the ends of a horizontal platform or deck which carries on its upper surface a plurality of trolleys adapted to be power driven along the length of the platform. Each trolley carries two pairs of upstanding hydraulic jacks, the upper ends of which are adapted to support and elevate an arcuate ceiling block from below. The position of one pair of jacks on each trolley can be adjusted horizontally with respect to its respective trolley. The entire gantry is wheel-mounted at its lower end for movement along the tunnel floor in a direction transverse to the direction of movement of the trolleys.

5 Claims, 8 Drawing Figures

74
105
102
100
103
108
8
8
92
136
150
62
104
106
109
60
8
8
101
107

GANTRY

DESCRIPTION OF THE PRIOR ART AND SUMMARY OF THE INVENTION

The invention relates to a gantry for moving and positioning heavy arcuate pre-cast tunnel sections.

Tunnels for underground trains and the like are often lined with an arcuate ceiling providing an arch, at least in system areas which function as stations. The arcuate tunnel segments are usually formed by pouring concrete in place and supporting it while it dries and cures to the desired strength. This is a difficult, expensive, and often dangerous undertaking because of the difficulty of transporting the concrete to the desired underground location and of assemblying and disassemblying the proper forms. Casting or otherwise forming the arcuate tunnel sections outside the tunnel and then moving them into position avoid many of these problems. However, while it is much easier to cast sections outside the underground environment, manuvering the heavy arcuate tunnel sections into position in the tunnel and installing them is a major difficulty.

According to the present invention as described in detail below, large arcuate tunnel sections can be moved on a unique gantry along the length of the tunnel in which the arcuate sections are being installed to form an arch. The sections can be moved, both horizontally and vertically into mating position to form an arch. Accordingly to one embodiment the gantry of this invention includes a framework which provides a horizontal platform carrying a pair of trolleys which are power driven along the length of the horizontal platform. The framework moves in a direction transverse to the direction of movement of the trolleys and is preferably adapted to move along the length of the tunnel where the arcuate sections are being installed.

The arcuate sections are supported on a plurality, for example two pairs of hydraulic jacks mounted on each trolley, are adjustable vertically to maneuver the arcuate sections to a position where they will mate and form an arch. Each of the jacks includes a saddle engaging the arch and pivotable about a direction transverse to the direction of movement of the trolleys to adjust for angular movement of the arcuate sections and ensure the saddle remains firmly in connection with the arcuate tunnel sections which it partially supports. At least one of the pairs of jacks on each of the two trolleys can be moved for a short distance in a direction transverse to the direction of movement of the trolley to compensate for slight misallignment of the two arcuate tunnel sections which mate to form the arch.

Many other objects and purposes of the invention will be clear from the following detailed description of the drawings.

DETAILED DESCRIPTION OF THE DRAWINGS

Reference is now made to FIGS. 1–8 which illustrate one embodiment of the unique gantry of this invention. The gantry is comprised of a framework 20 and a pair of trolleys 22 and 24 mounted on an elevated platform or deck 26 of framework 20 for movement transverse to the direction of movement of the framework 20 to properly position arcuate tunnel sections, for example sections 28 and 30 in FIG. 1.

Figure 1:
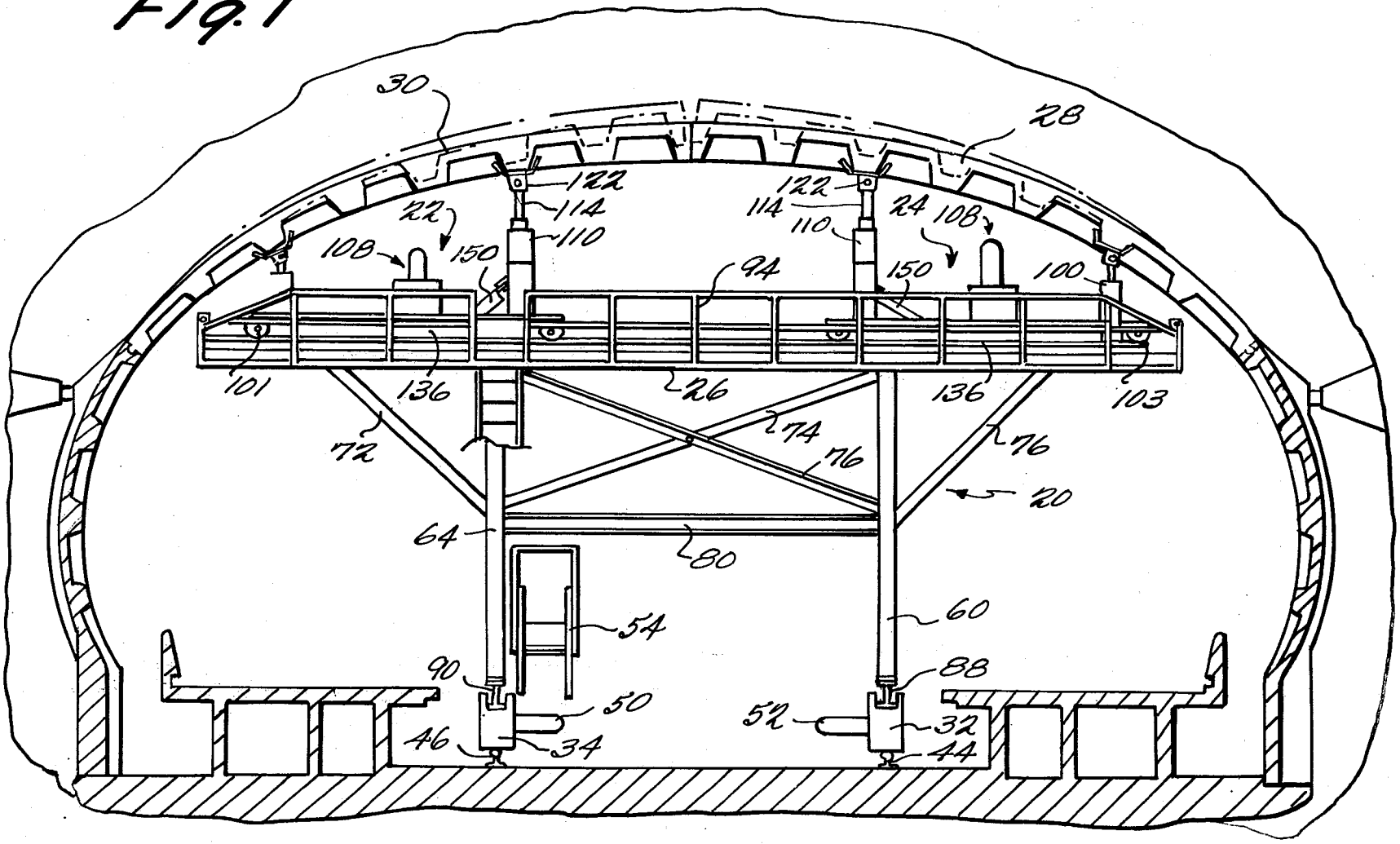
FIG. 1 shows an end view of the unique gantry of this invention in use lining a tunnel with arcuate, pre-cast, tunnel sections.
Figure 6:
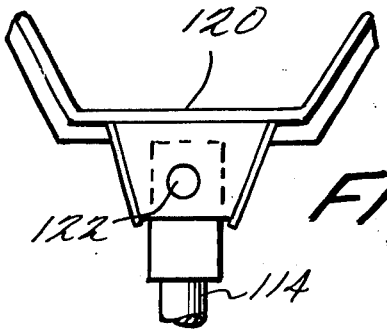
FIGS. 6 and 7 show a detailed front and side view of one of the saddles for the hydraulic jacks mounted on the trolleys.
Figure 7:
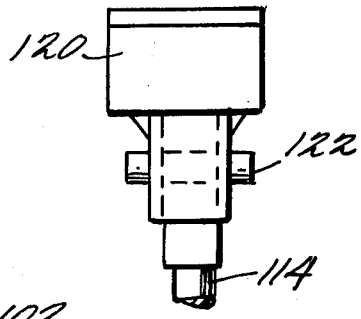
Figure 2:
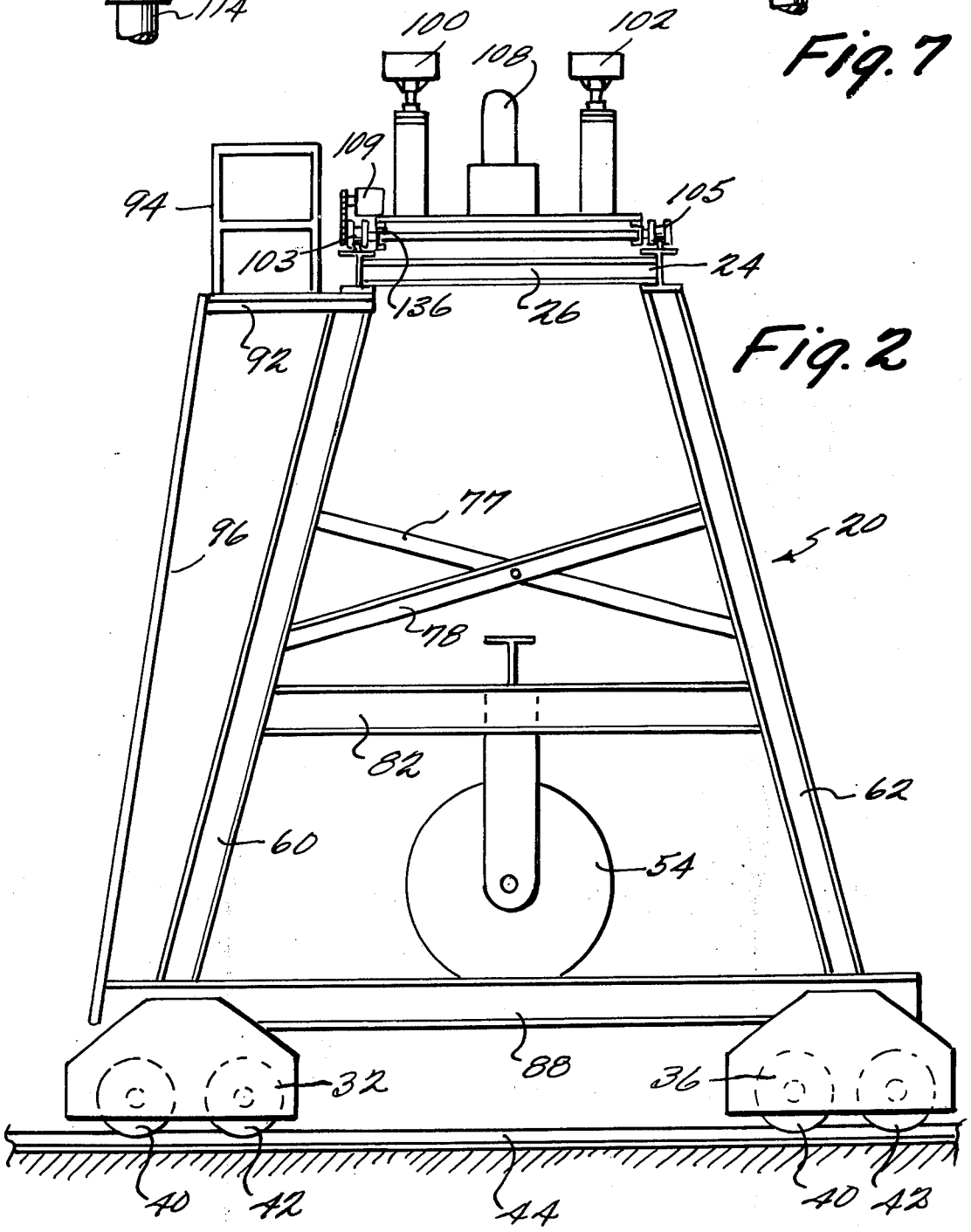
FIG. 2 shows a side view of the gantry of FIG. 1.

Framework 20 further includes four wheel casings 32, 34, 36 and one which cannot be seen in FIGS. 1 and 2, but which is identical to the illustrated wheel casings. Each of the casings 32, 34 and 36 mounts a pair of wheels 40 and 42, as can be seen in FIG. 2, to engage rails 44 and 46 for movement along the length of the tunnel. Rails 44 and 46 may be the rails on which the train will move through the tunnel after it has been finished or may be laid solely for the purpose of moving the gantry and the arcuate sections which it transports. Wheels 40 and 42 of casings 32 and 34 are driven by suitable motors, for example motors 50 and 52, illustrated in the drawings. Power to operate the motors 50 and 52 as well as the other hydraulic and electrical elements of the gantry is supplied from a suitable source by means of a power line which is reeled on conventional cable take-up reel 54 which prevents the cable from being fouled as the gantry moves along the tunnel.

Framework 20 further includes four vertical supporting legs 60, 62–64 and a fourth leg behind leg 64 in FIG. 1 and behind leg 62 in FIG. 2. Platform 26 is bolted or otherwise attached to these four legs. Cross struts 70, 72, 74, 76, 77 and 78 provide additional strength for the framework 20. Horizontal support pieces 80 and 82 together with the pieces behind piece 80 in FIG. 1 and piece 82 in FIG. 2 extend between the four vertical legs to provide additional support. Horizontal bottom beams 88 and 90 connect casing 32 to casing 36 and casings 34 to the casing behind it in FIG. 1, respectively. The legs, struts pieces and platform may be conventionally formed of steel beams bolted or otherwise fastened together.

An observation platform 92 with a protective railing 94 on the top thereof is attached to one side of platform 26 and provided with a ladder 96 which helps to support observation platform 92 and which provides access to platform 26.

Reference is now made particularly to FIGS. 3–6 in which can be seen one of the trolleys 24 which moves on platform 26 to manuever arcuate section 30 into position to mate with section 28 and form an arch. Trolley 24 mounts four conventional hydraulic jacks 100, 102, 104 and 106. Hydraulic pump 108 mounted in the middle of trolley 24 provides the hydraulic power for operating jacks 100, 102, 104 and 106. Suitable manual controls are provided either on the observation platform or below platform or deck 26 for operating the various hydraulic jacks.

Four wheels 101, 103, 105 and 107 support the base 136 of trolley 24. Wheel 101 is driven by motor 109 to move trolley 24 along platform or deck 26.

Each of the jacks, for example jack 106, is comprised of a hollow casing 110 in which a conventional hydraulic cylinder 112 is pivotably mounted by connection 116. Shaft 114 of cylinder 112 moves vertically in response to application and release of hydraulic pressure. Cylinder 114 is loosely journaled in mount 110 so as to permit some slight pivotal movement about pivot connection 116. A saddle 120 is pivotably connected by pin 122 to shaft 114 to permit additional pivoting about pin 122 of a few inches to maintain firm support of the arcuate sections as it is angularly shifted during installation.

On each of the two trolleys 22 and 24 the pair of hydraulic jacks which are adjacent to each other can be both moved for a short distance along the direction in which framework 20 moves and along the direction of the tunnel. Thus, it is not absolutely necessary that the two arcuate sections be initially placed exactly in the correct alignment on the four hydraulic jacks 100, 102, 104 and 106. It has been found that some slight misalignment of the heavy sections will almost always occur. This can be corrected by a small horizontal movement of one or both of the adjacent pairs of hydraulic jacks on trolleys 22 and 24.

Figure 3:
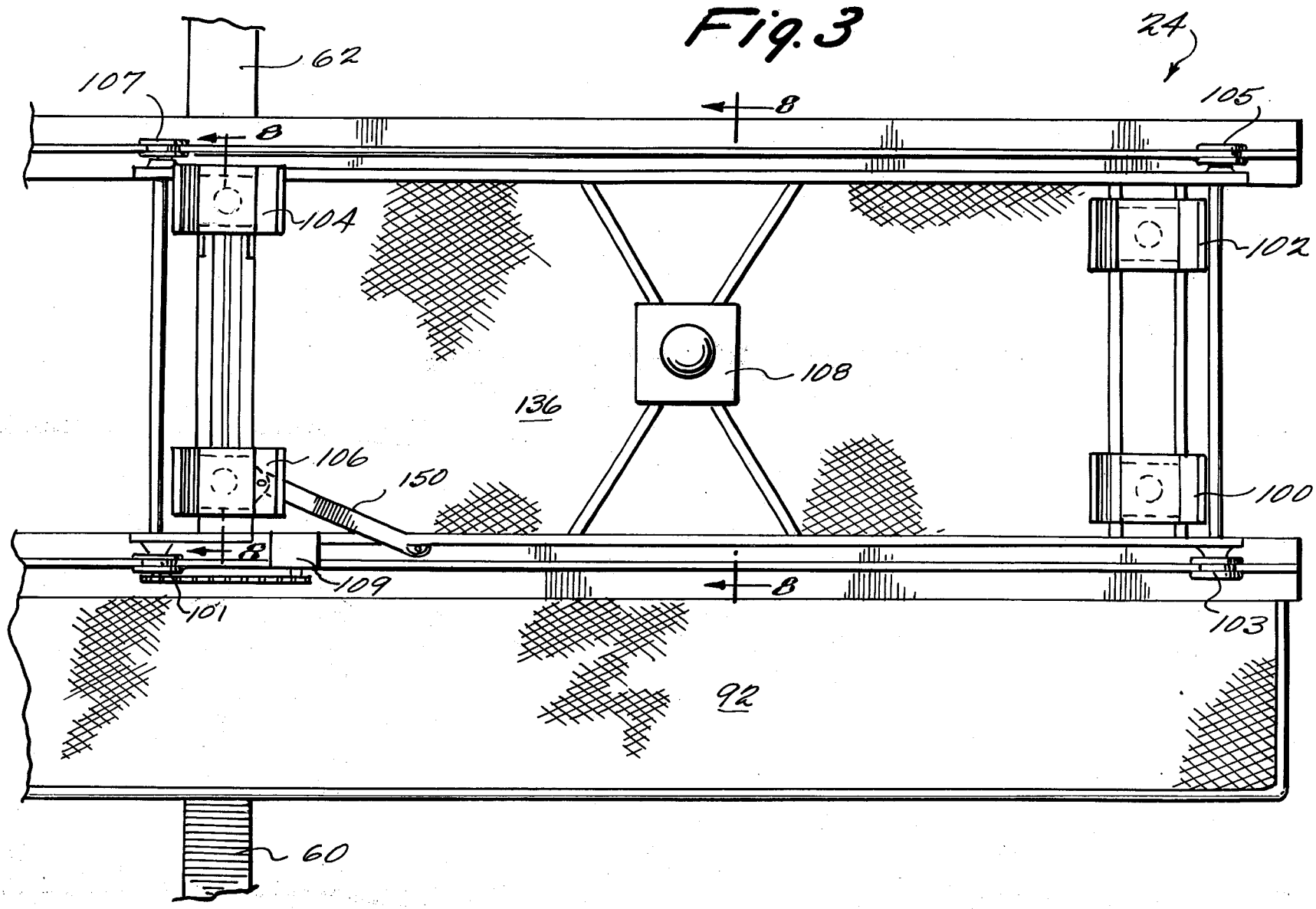
FIG. 3 shows a top plan view along the lines 3—3 in FIG. 2.
Figure 4:
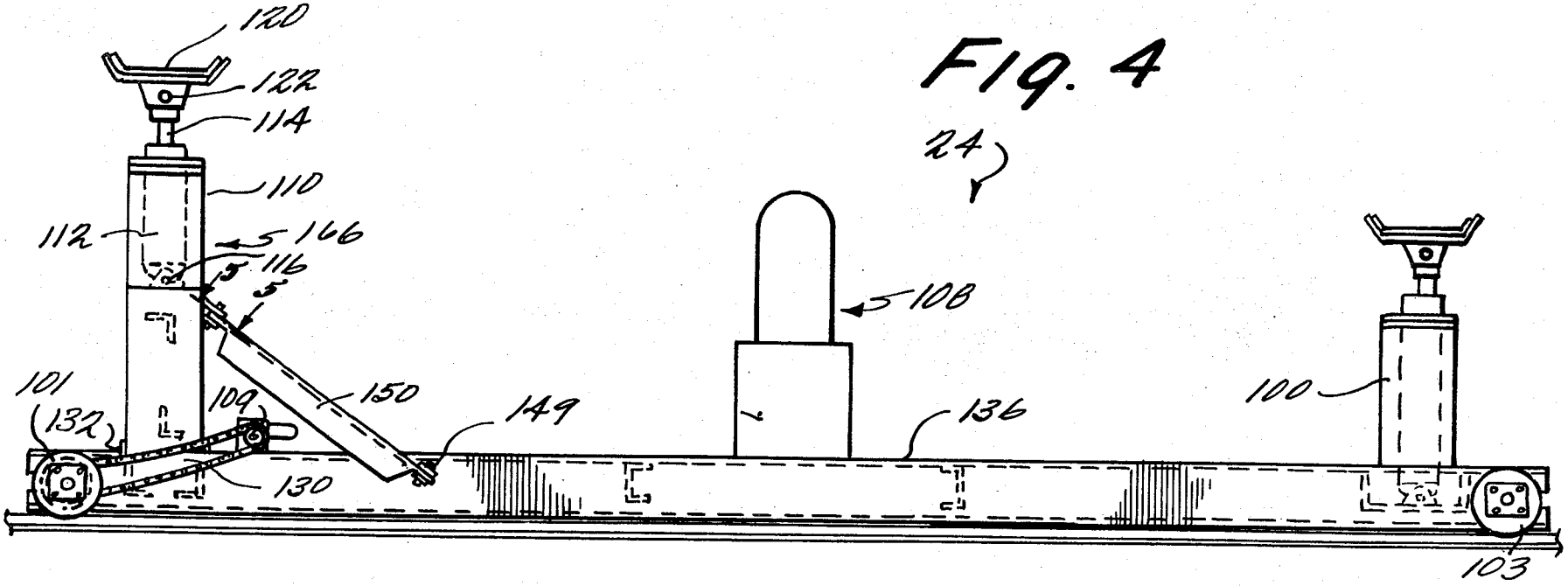
FIG. 4 shows a side view of one of the trolleys which moves on a deck of the gantry framework.
Figure 8:
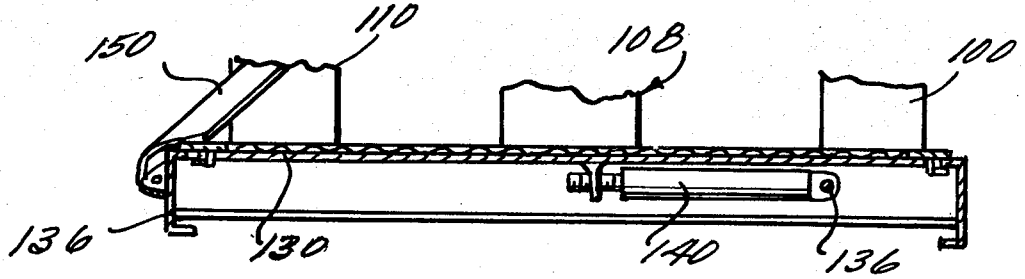
FIG. 8 shows a sectional view along the lines 8—8 in FIG. 3.
Figure 5:
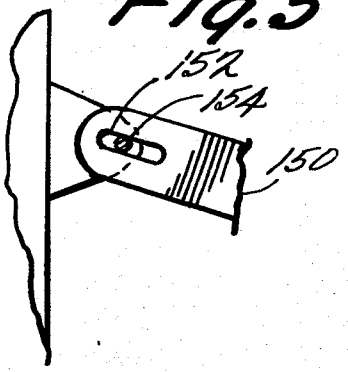
FIG. 5 shows a detailed view of the connection between the brace and one of the hydraulic jacks along the trolley for controlling movement of one pair of the jacks along a direction transverse to the direction of movement of the trolley.

For example referring to FIGS. 3 and 4, hydraulic jacks 104 and 106 are mounted on a platform 130 which is mounted for movement along a channel 132 formed by beams 133 and 134 in base 136 of trolley 24. As illustrated in FIG. 8 hydraulic ram 140 is pivotably connected to the trolley base 136 at one end and to platform 130 to permit movement of that platform 130 for a short distance, for example 3 inches. Brace 150 is pinned at one side to base 136 by a pivot pin 149 and pivotably connected to casing 110 by a connection which is illustrated in detail in FIG. 5. Brace 150 is illustrated in FIG. 5 is provided with a slot 152 in which pin 154 moves to provide a few inches of movement for horizontal plate 130 and hydraulic jacks 104 and 106 mounted thereon.

In order to install a pair of arcuate tunnel sections to form an arch, the pre-cast sections are first transported from the location of casing, for example on a flat bed truck to the location where the arcuate section is to be assembled. The heavy sections, which may each weigh 14 tons or more, are then lowered onto the two trolleys 22 and 24 with the saddles of the hydraulic jacks engaging the downward extending portions of the arcuate sections. The gantry is then moved along the direction of the tunnel until it is located below where the arch is to be formed. The hydraulic jacks on trolleys 22 and 24 are then operated to vertically lift the arcuate sections and then the trolleys are moved outward until the arches have been properly connected to side connections of the vertical wall. Next the arcuate sections are gradually lowered from the position illustrated in the dash lines of FIG. 1 until the two opposing sections mate and the arch is held in place by compression.

Many changes and modifications in the above described embodiment of the invention can, of course, be carried out with departing from the scope thereof. Accordingly that scope is intended to be limited by the scope of the appended claims.

What is claimed is:

1. A gantry for carrying out operations adjacent a ceiling structure comprising:

an upright supporting framework having an upper deck facing the ceiling structure;

wheel means carried by the framework below the deck for rendering the framework movable along a supporting surface;

at least one trolley wheel-mounted on the upper surface of the deck for movement therealong;

drive means for moving said trolley along the deck;

two pairs of generally upright jack means carried by said trolley, each of said jack means having a free upper end adapted to engage a work piece;

a platform mounting one of said pairs; means for moving said platform and the jacks mounted thereon in a horizontal direction transverse to the direction of movement of said trolley;

said trolley including a base forming a channel in which said platform slides;

said moving means including a hydraulic ram connected between said platform and said base of said trolley and a brace pivotably connected between said base and said platform.

2. A gantry as in claim 1 including at least two trolleys mounted on the upper surface of said deck.

3. A gantry as in claim 1 wherein said jack means are hydraulic and including a hydraulic pump mounted on said trolley.

4. A gantry as in claim 1 wherein each of said jack means includes a cylinder mount, a hydraulic cylinder slidable in said mount and pivotably connected to said mount for limited movement and a saddle pivotably connected to said cylinder.

5. A gantry as in claim 1 including motor means for driving said wheel means carried by said framework.

* * * * *